United States Patent [19]

Tsuda

[11] 4,005,433

[45] Jan. 25, 1977

[54] SMALL WAVELENGTH HIGH EFFICIENCY ANTENNA

[75] Inventor: George I. Tsuda, Fullerton, Calif.

[73] Assignee: Hughes Aircraft Company, Culver City, Calif.

[22] Filed: Dec. 5, 1975

[21] Appl. No.: 638,101

[52] U.S. Cl. ..... 343/819; 343/840

[51] Int. Cl.[2] ..... H01Q 19/30

[58] Field of Search ..... 343/840, 767, 819

[56] References Cited

UNITED STATES PATENTS

| | | | |
|---|---|---|---|
| 2,407,057 | 9/1946 | Carter | 343/840 |
| 2,540,518 | 2/1951 | Gluyas | 343/840 |
| 2,556,087 | 6/1951 | Iams | 343/767 |
| 2,988,741 | 6/1961 | Brown et al. | 343/840 |
| 3,176,301 | 3/1965 | Wellons et al. | 343/840 |
| 3,218,646 | 11/1965 | Ehremspeck | 343/819 |
| 3,430,244 | 7/1952 | Bartlett | 343/840 |

*Primary Examiner*—Harold A. Dixon
*Attorney, Agent, or Firm*—Lindenberg, Freilich, Wasserman, Rosen & Fernandez

[57] ABSTRACT

A small wavelength antenna comprises a paraboloidal reflector with a rim about its periphery and a single feed dipole, backed by a circular cup-shaped cavity. The reflector, dipole and cavity are symmetrically aligned about the antenna axis. The reflector diameter is on the order of 3 to 4λ and the cavity diameter is less than 1λ and more than ½λ, where λ is any wavelength with the band of operation of the antenna. The cavity depth is on the order of 0.25 of a selected wavelength within the band, at which maximum pattern symmetry is desired, and the dipole is substantially flush with the open end of the cavity. The rim height is on the order of one-half of a selected wavelength within the band of operation of the antenna at which gain is to be optimized.

20 Claims, 4 Drawing Figures

Fig. 1
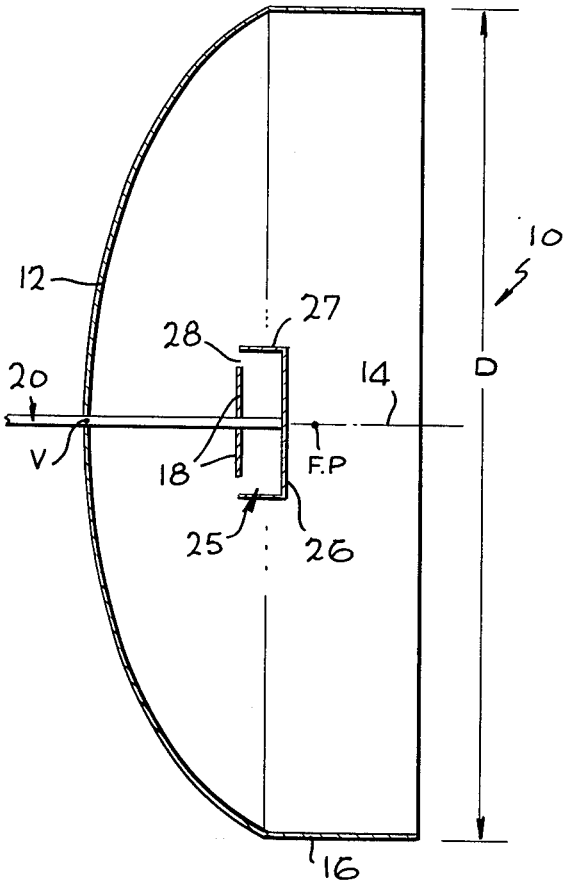
Fig. 3
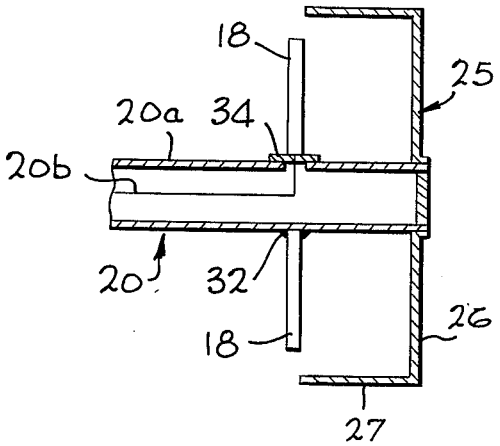
Fig. 4
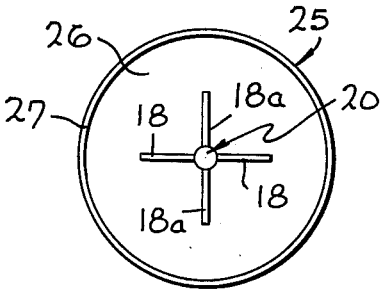
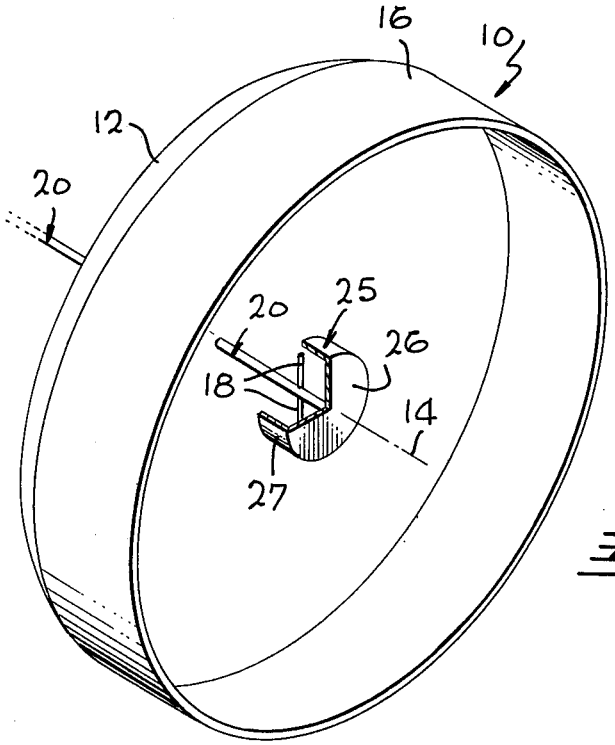
Fig. 2

SMALL WAVELENGTH HIGH EFFICIENCY ANTENNA

BACKGROUND OF THE INVENTION

1. Field of the Invention

The present invention generally relates to a directional antenna and, more particularly, to a relatively broad band high gain short backfire antenna.

2. Description of the Prior Art

In U.S. Pat. Nos. 3,438,043 and 3,508,278 short backfire antennas are described. Basically, the antenna taught therein consists of a main planar reflector, a feed element, such as a dipole, in front of the planar reflector, and a second reflector in the form of a plurality of dipoles or a flat disc, serving as a splash plate in front of the feed element. Such an antenna, i.e., one with a planar main reflector has several very significant limitations. If a large aperture, say on the order of more than 3λ is required to produce a narrow beam with high gain the energy does not collimate well by the planar reflector with the single feed element. Thus, an array of feed elements is required. Also, the bandwidth of the antenna with the planar reflector is relatively limited. Furthermore, spillover in the prior art antenna, even when employing a rim around the planar reflector, is quite high which is undesirable, since it increases the noise and may affect adjacent antennas. Also, in the prior art antenna the back radiation of the feed element is quite high and the radiation pattern in the E and H planes is not equalized, resulting in higher cross polarization, all of which reduce the antenna efficiency.

SUMMARY OF THE INVENTION

The present invention comprises a paraboloidal primary reflector with a rim about its periphery and a single feed element, e.g., a dipole which is backed by a circular cup-shaped cavity, all of which are symmetrical about the antenna axis. The cavity serves to minimize the backward radiation from the dipole. Briefly, some of the energy directed to the cavity from the dipole is reflected by the cavity to the paraboloidal reflector, while some of the energy is converted by the cavity which generates a higher order mode and which is directed from the cavity to the paraboloidal reflector.

The cavity is dimensioned and the dipole positioned with respect thereto so that the energy of the two modes are in phase and proper amplitude, so as to produce a symmetrical radiation pattern, i.e., one in which the radiation patterns in the E and H planes are equalized. Consequently, spillover and cross polarization are minimized, resulting in higher efficiency. The paraboloidal reflector accounts for the relatively broad band of the antenna and enables the use of single feeding dipole even with relatively large reflector diameter, e.g., on the order of 3 wavelengths or more. Also, the equalization of the radiation pattern in the E and H planes is more readily achieved with the cavity and the paraboloidal reflector. The dipole and cavity are spaced from the reflector vertex at an appropriate distance to optimize the distribution of the energy over the entire reflector surface. The height of the rim at the reflector periphery is chosen to contribute to the energy collimation and thereby increase the antenna efficiency as well as reduce spillover.

The novel features of the invention are set forth with particularity in the appended claims. The invention will best be understood from the following description when read in conjunction with the accompanying drawings.

BRIEF DESCRIPTION OF THE DRAWINGS

FIG. 1 is a cross sectional view of one embodiment of the invention;

FIG. 2 is an isometric view of the embodiment of FIG. 1;

FIG. 3 is a partial cross sectional view of the embodiment shown in FIG. 1; and FIG. 4 is a top view of cross dipoles and a cavity forming part of another embodiment of the invention.

DESCRIPTION OF THE PREFERRED EMBODIMENTS

Attention is directed to FIG. 1 which is a cross sectional view of an antenna 10 in accordance with the present invention. The antenna includes a paraboloidal primary reflector 12, symmetrically positioned about the antenna's longitudinal axis 14. The paraboloidal reflector's vertex is designated by V and its focal point by F.P. Extending outwardly from the periphery of the reflector 12 is a rim 16. Positioned in front of the reflector 12 is a dipole 18, which acts as the antenna feed element, and which is located symmetrically about axis 14. The dipole 18 is assumed to be held securely in position by a stiff rod 20 which extends through the reflector vertex to the back of the reflector. The dipole 18 is fed from an appropriate energizing source (not shown) through leads which are assumed to extend through the rod 20, in a manner well known by those familiar with the art. A specific arrangement, actually reduced to practice, will be described hereinafter.

The present invention is directed to a small wavelength high efficiency antenna. The term "small" relates to the antenna aperture, namely the diameter D of the reflector 12 in terms of any wavelength (λ) within the band of operation. The antenna is particularly advantageous when D is greater than 2λ within the band of operation. The antenna is particularly advantageous when D is greater than 2λ, e.g., 3–4λ, which may be required to provide a relatively large aperture so as to achieve sufficient gain and a sufficiently narrow beam. It is believed that many of the antenna advantages may be achieved as long as D is not greater than 10λ. Hereinafter the antennas will be described in connection with D being between 3 and 4λ.

In the prior art small or short backfire antennas the main reflector is planar, i.e., flat, rather than paraboloidal. It was found that with a planar reflector on the order of 3 to 4λ the required power distribution cannot be achieved with a single feed element, such as dipole 18. A planar reflector of 3 to 4λ requires several feed elements, each with a separate splash plate. This is most disadvantageous, since it increases the complexity of the feed arrangement and further increases feed blockage thereby reducing the overall attainable efficiency.

However, in the antenna of the present invention, by incorporating the paraboloidal reflector a single feed dipole 18 is sufficient, even though D is on the order of 3 to 4λ. In addition, due to the paraboloidal reflector 12 the antenna bandwidth is increased significantly over the much narrower bandwidth attainable in the prior art with a planar reflector.

As shown in FIG. 1, the antenna 10 includes a circular cup-shaped cavity 25 which is symmetrically positioned about axis 14 on the opposite side of the dipole 18 with respect to reflector 12. The cavity is formed of a bottom circular plate 26 from which the cavity rim 27 extends. The cavity opening 28 faces the dipole. The cavity 25, which as shown in FIG. 1 is assumed to be supported by the portion of the rod 20 extending beyond dipole 18, performs several unique functions. It serves as the splash plate for the dipole. It reflects back to the reflector 12 some of the energy directed thereto from the dipole 18. However, in addition and more importantly, some of the energy which is directed to the cavity from the dipole 18 is generated by the cavity as a higher mode, e.g., $TM_{11}$, and is directed by the cavity to the primary reflector 12. FIG. 2 is an isometric view of the antenna 10 in which like numerals designate like elements, as in FIG. 1.

By appropriately selecting the cavity dimensions and the relative location of the dipole 18 with respect to the cavity opening 28 the two modes can be brought in phase and their magnitudes controlled to produce a symmetrical radiation pattern which is then reflected by the reflector 12. Consequently, the radiation patterns in the E and H planes can be equalized without having to reshape the symmetrical paraboloidal reflector 12. By providing a symmetrical radiation pattern, cross polarization and spillover are greatly reduced, thereby greatly increasing the antenna efficiency.

For proper operation, the cavity diameter, i.e., the diameter of plate 26 should be greater than 0.5λ and less than 1λ, where λis any wavelength in the desired band of operation of the antenna. The cavity depth should be about 0.25 of the wavelength at which it is desired to optimize the symmetrical radiation pattern and the dipole 18 should preferably be located flush with the cavity opening 28. It should be pointed out however that since the antenna is operable over a relatively broad band the exact depth of the cavity and the location of the dipole with respect thereby may be varied, based on minor experimentation to achieve desired performance at desired points within the band.

The dipole 18 together with the cavity 25 can be viewed as a feed arrangement which is tunable by varying cavity depth and dipole location to produce substantially equal radiation patterns in the E and H planes from the paraboloidal reflector 12 at a selected wavelength and thereby minimize cross polarization and spillover. The rim 16 also assists in reducing spillover. However, in addition by choosing the rim to be of appropriate height it also assists in collimating the energy and thereby increase the overall efficiency. Preferably, the rim height should be on the order of one-half of a wavelength or a multiple thereof at which gain optimization is desired.

The distance of the dipole 18 from the reflector vertex should be chosen so as to insure proper radiation distribution over the reflector 12 area. If no external impedance matching devices, such as a transformer, are used, the distance of the dipole 18 from the vertex should be on the order of an odd integer multiple of 0.25 of the wavelength at which gain optimization is desired.

It should be pointed out that as shown in FIG. 1 the dipole 18 is not located at the focal point F.P. This is particularly advantageous for space application. In such applications any solar energy directed to the reflector 12 would collimate at the focal point and therefore may potentially damage a dipole located thereat. In the prior art whenever a paraboloidal reflector is used the feed element, such as the dipole, is typically located at the focal point. In the present invention, however the dipole need not, and typically is not, located at the focal point, thereby eliminating the potential damage thereto from any solar energy collimated by the reflector 12 at the focal point. It should be stressed that although in FIG. 1 the dipole 18 and the cavity 25 are shown located ahead of the focal point F.P., i.e., closer to the vertex, the invention is not intended to be limited thereto. The dipole may be located beyond the focal point depending on the required distance of the dipole and cavity from the reflector for proper energy distribution over the reflector area. Also, in some cases the dipole and cavity may be positioned so that the focal point may lie between the dipole 18 and the bottom plate 26 of the cavity 25.

The teachings of the invention were incorporated in an antenna which was designed to operate over at least the frequency range from 1680MHz to 2030MHz. The antenna which was actually reduced to practice had the following parameters:

| | |
|---|---|
| Paraboloidal Diameter (D) | 22" |
| Paraboloidal Focal Distance | 6" |
| Height of Rim 16 | 3.5" |
| Cavity Diameter | 4.0" |
| Cavity Depth | 1.5" |
| Location of dipole 18 from Vertex | 4.0" |

At 1687MHz, λ = 7 inches and at 20MHz, λ ≃ 5.81 inches. The paraboloidal diameter D of 22 inches is therefore between 3 and 4λ of any wavelength within the band. The cavity diameter of 4.0 inches is more than ½λ and less than 1λ of any wavelength within the band. The rim height of 3.5 inches was chosen to equal one-half wavelength at the lower end of the band in order to maximize the gain at this end. The gain was 19dB. The cavity depth of 1.5 inches was chosen to be on the order of 0.25 wavelength near the upper end of the band. This was done in order to optimize the pattern symmetry at the upper end where the beam width is narrower than at the lower end, and therefore the drop off is sharper, resulting in a higher gain difference in the E and H planes, unless the pattern symmetry is enhanced.

Attention is now directed to FIG. 3 which is a simplified cross sectional view of an arrangement which was used to support the dipole 18 and the cavity 25. The supporting rod 20 comprised a rigid outer metal tube 20*a*, serving as an outer conductor, with a center conductor 20*b* extending therethrough. The two conductors in essence formed a coax. One element of the dipole 18 was soldered to the tube 20*a* at a joint 32, while the inner conductor 20*b* was electrically connected to the other dipole element. The latter was electrically insulated from the tube 20*a* by an electrical insulator 34, with the inner conductor 20*b* extending through an opening in the metal tube 20*a* and insulator 34 to the dipole element. The metal tube 20*a* extended beyond the dipole 18 and was used to mechanically attach the cavity 25 thereto. The opposite ends of tube 20*a* and conductor 20*b* extended through the reflector 12 to the back end thereof. An appropriate washer was used to electrically isolate the reflector from tube 20*a*. The dipole was excited by connecting tube 20*a* and conductor 20*b* to an appropriate energizing source.

The particular antenna, hereinbefore described, was designed for use in a geostationary meterological satellite, which was designed to transmit at the lower end of the band. Therefore, the gain at this end was optimized. However, to insure proper illumination of the earth at the higher end of the band, where the beam is narrower, the pattern symmetry was optimized by choosing the cavity of the depth to be on the order 0.25 of a wavelength near the upper end of the band in order to insure proper earth illumination up to the earth edge in both the E and H planes.

It should be appreciated however that the invention is not intended to be limited to the specific embodiment hereinbefore described. If desired the gain and pattern symmetry may be optimized at different wavelengths within the band of operation or at the same wavelength by the proper selection of the cavity dimensions, the location of the dipole 18 with respect thereto and by the proper height of the rim 16 and the location of the dipole with respect to the paraboloidal reflector vertex. In a conventional antenna with a paraboloidal reflector, fed by a dipole, the efficiency is typically on the order of 50–55%. In the antenna of the present invention one can view the dipole feeding the cavity which acts as an oversized circular guide with $TE_{11}$ mode. In this case the theoretical efficiency is about 72%. By properly dimensioning the cavity so that it generates the higher order mode, e.g., $TM_{11}$ mode which is reflected to the paraboloidal reflector from the cavity the theoretical efficiency can be increased to nearly 83%.

As previously pointed out the cavity diameter should be more than 0.5λ and less than 1λ of any wavelength within the band of operation. The useful band of operation is generally on the order of 30–40%. For a small ratio of paraboloidal focal distance, F and diameter D, i.e., for small F/D on the order of 0.3 the cavity size should preferably be on the order of 0.6λ.

The antenna of the present invention provides many significant advantages over a conventional antenna, fed by a dipole and backed by a splash plate. The antenna efficiency can be made quite high due to the ability to generate, by means of the cavity, a higher order mode which can be properly phased with the other mode ($TE_{11}$) and matched in amplitude therewith. The antenna construction is very simple. Also with the present antenna the E and H plane patterns can be equalized without shaping the main paraboloidal reflector. In the present antenna the spillover is low, resulting in low noise. Also, it improves the isolation between the present antenna and any antennas, which may be located nearby, such as on a satellite. Another advantage of the present invention results from the fact that the feed dipole need not be located at the focal point, thereby preventing potential damage from collimating solar energy if the dipole were located at the focal point.

It should be stressed that in the antenna of the present invention various parameters of the antenna may be varied to produce the desired gain and pattern symmetry at a desired wavelength or at different wavelengths within the band of operation. These parameters include the cavity dimensions, (diameter and depth), the dipole location with respect thereto, the height of rim 16 and the location of the dipole with respect to the reflector vertex, as well as, the reflector diameter D. It should also be pointed out that if desired instead of one dipole 18 two cross dipoles, such as shown in FIG. 4, may be employed at or near the cavity opening. A view of two cross dipoles with the cavity as viewed from the reflector is shown in FIG. 4. Therein the dipoles are designate by numerals 18 and **18*a* and are shown supported by rod 20**.

It should further be stressed that the antenna is not limited to the band of about 1680–2030MHz. The antenna can be employed in any desired frequency range. For example, the antenna can be employed of about 800MHz and less and was found to be useful even in the X band, provided the reflector diameter D, the cavity dimensions and the rim height are properly scaled to the desired band of operation. It should be pointed out however that the advantages of the antenna are realized when D is not less than 2 ½λ and not more than 10λ of any wavelength in the desired band, and that the cavity diameter should be not less than 0.5λ and less than 1λ of any wavelength within the band.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. An antenna comprising:

a paraboloidal reflector defining a circular opening of a diameter D, said opening being symmetrically aligned about an antenna longitudinal axis with the circular opening in a plane perpendicular to said axis, said paraboloidal reflector having a focal point on said axis;

feed means spaced apart from the vertex of said reflector and symmetrically positioned about said axis, at other than said focal point; and a circular cup-shaped cavity spaced symmetrically about said axis on the other side of said feed means remote from said reflector, with the open end of said cavity toward said reflector.

2. The antenna as described in claim 1 further including a rim member extending outwardly from the reflector periphery and having a length on the order of an integer multiple of ½ λ where λ is any wavelength within the band of operation of the antenna.

3. The antenna as described in claim 1 wherein said circular cavity has a diameter on the order of less than 1λ and more than ½λ, where λ is any wavelength in a frequency band of operation of said antenna.

4. The antenna as described in claim 1 wherein D is on the order of not less than 2 ½ wavelengths and not more than 10 wavelengths of any wavelength in the frequency band of operation of said antenna.

5. The antenna as described in claim 4 wherein said circular cavity has a diameter on the order of less than 1λ and more than ½λ, where λ is a wavelength in a frequency band of operation of said antenna.

6. The antenna as described in claim 5 further including a rim member extending outwardly from the reflector periphery, the rim member height being on the order of an integer multiple of one half of a wavelength in the frequency band of operation of said antenna, and wherein the depth of said cavity is on the order of one quarter of a wavelength in the frequency band of operation of said antenna.

7. The antenna as described in claim 5 wherein said feed means includes at least one dipole positioned substantially flush with the open end of said cavity and the antenna further includes a rim member extending outwardly from the reflector periphery.

8. A small wavelength antenna comprising:

a paraboloidal reflector defining a circular opening of a diameter D, said opening being symmetrically aligned about an antenna longitudinal axis with the circular opening in a plane perpendicular to said axis;

feed means spaced apart from the vertex of said reflector and symmetrically positioned about said axis; and a circular cup-shaped cavity spaced symmetrically about said axis on the other side of said feed means remote from said reflector, with the open end of said cavity toward said reflector, with said cavity reflecting back to said reflector part of the energy directed thereto by said feed means and generating a higher order mode which is substantially in phase with the mode directed by said feed means to said reflector.

9. The antenna as described in claim 8 wherein said reflector defines a focal point in a first plane parallel to a second plane in which the reflector's circular opening is located, and said feed means are positioned at other than in said first plane.

10. The antenna as described in claim 8 wherein said cup-shaped cavity defines a back plate remote from its open end, which is located at other than said first plane.

11. The antenna as described in claim 10 wherein the cavity diameter is less than 1λ and more than ½λ, where λ is any wavelength within the band of operation of said antenna.

12. The antenna as described in claim 8 wherein the cavity diameter is less than 1λ and more than ½λ, where λ is any wavelength within the band of operation of said antenna, wherein D is on the order of not less than 2½λ and less than 10λ, and further including a rim extending outwardly from the reflector periphery, the rim height being on the order of *m* times one half of a wavelength within the band of operation of said antenna, where *m* is an integer.

13. The antenna as described in claim 8 wherein the cavity diameter is less than 1λ and more than ½λ, where λ is any wavelength within the band of operation of said antenna.

14. The antenna as described in claim 13 wherein D is on the order of not less than 2½λ and less than 10λ.

15. The antenna as described in claim 14 further including a rim extending outwardly from the reflector periphery, the rim height being on the order of *m* times one half of a wavelength within the band of operation of said antenna, where *m* is an integer.

16. The antenna as described in claim 15 wherein the cavity depth is on the order of one quarter of a wavelength within the band of operation of said antenna.

17. The antenna as described in claim 14 wherein said feed means is a single dipole.

18. The antenna as described in claim 17 wherein said dipole is substantially flush with the open end of said cup-shaped cavity.

19. The antenna as described in claim 14 wherein said feed means comprises a pair of cross dipoles.

20. The antenna as described in claim 19 wherein said cross dipoles are substantially flush with the open end of said cup-shaped cavity.

* * * * *